US009282770B2

(12) United States Patent
Street et al.

(10) Patent No.: US 9,282,770 B2
(45) Date of Patent: Mar. 15, 2016

(54) DEVICE FOR STORING AND SMOKING TOBACCO AND TOBACCO-RELATED PRODUCTS IN AN INCLEMENT WEATHER ENVIRONMENT

(71) Applicants: Cale Street, Mundelein, IL (US); Mark Behar, Woodinville, WA (US); Sacha Sprague, Mundelein, IL (US)

(72) Inventors: Cale Street, Mundelein, IL (US); Mark Behar, Woodinville, WA (US); Sacha Sprague, Mundelein, IL (US)

( * ) Notice: Subject to any disclaimer, the term of this patent is extended or adjusted under 35 U.S.C. 154(b) by 439 days.

(21) Appl. No.: 14/032,542

(22) Filed: Sep. 20, 2013

(65) Prior Publication Data

US 2014/0083440 A1 Mar. 27, 2014

Related U.S. Application Data

(60) Provisional application No. 61/704,518, filed on Sep. 23, 2012.

(51) Int. Cl.

| | |
|---|---|
| ***A24F 13/00*** | (2006.01) |
| ***A24F 13/12*** | (2006.01) |
| ***A24F 47/00*** | (2006.01) |
| *A41D 19/00* | (2006.01) |

(52) U.S. Cl.

CPC ..... *A24F 13/00* (2013.01); *A24F 13/12* (2013.01); *A24F 47/00* (2013.01); *A41D 19/0024* (2013.01); *A41D 19/0079* (2013.01)

(58) Field of Classification Search

CPC . A24D 19/0024; A24D 19/0079; A24F 13/22

USPC ..... 19/24, 79

See application file for complete search history.

(56) References Cited

U.S. PATENT DOCUMENTS

| | | | | |
|---|---|---|---|---|
| 1,902,426 | A | 3/1933 | Strasser | |
| 2,530,688 | A | 11/1950 | Ducot | |
| 2004/0148681 | A1* | 8/2004 | Isom | A41D 19/0079 2/160 |
| 2014/0053854 | A1* | 2/2014 | Barry, Jr. | A24F 47/00 131/178 |

FOREIGN PATENT DOCUMENTS

| | | | |
|---|---|---|---|
| DE | 3309309 | A1 | 9/1984 |
| EP | 0527263 | A1 | 2/1993 |

OTHER PUBLICATIONS

PCT International Search Report and the Written Opinion dated Mar. 27, 2014; Application No. PCT/US2013/060844.

* cited by examiner

*Primary Examiner* — Michael H Wilson
*Assistant Examiner* — Eric Yaary
(74) *Attorney, Agent, or Firm* — The Dobrusin Law Firm, PC

(57) ABSTRACT

The present invention provides a hand worn smoking device comprising a glove having a burning reservoir for containing substance to be smoked, a reservoir closing feature, a smoke transport pathway, and an oral interface wherein the burning reservoir is connected to the oral interface via the smoke transport pathway allowing the burning reservoir to be in smoke communication with the oral interface during use. The present invention also includes a method of smoking the substance to be smoked using this device.

21 Claims, 12 Drawing Sheets

DEVICE FOR STORING AND SMOKING TOBACCO AND TOBACCO-RELATED PRODUCTS IN AN INCLEMENT WEATHER ENVIRONMENT

CLAIM OF BENEFIT OF FILING DATE

This application claims the benefit of the filing date of U.S. Provisional Application Ser. No. 61/704,518 titled: "Device for Storing and Smoking Tobacco and Tobacco-Related Products in an Inclement Weather Environment" filed on Sep. 23, 2012, which is incorporated herein by reference for all purposes.

FIELD OF THE INVENTION

The present invention relates to a device to wear on the hand, especially during inclement weather, that contains the means to store, protect, and smoke substances such as tobacco and tobacco-related products without the need to remove the device from the hand.

BACKGROUND OF THE INVENTION

Many outdoor sports and activities, including downhill skiing and snowboarding, are conducted in inclement weather conditions consisting of cold temperatures and high moisture. Protective gear and clothing is usually worn during these activities in order to provide warmth, dryness, and general protection for the skin. Full-fingered gloves are often used during winter activities to warm and protect the hands while still allowing for some degree of movement and use of digits for manipulation. Furthermore, gloves are often used in many other outdoor sports and activities such as motorcycling, hiking, biking, etc.

Despite growing and heavily publicized health hazards, a large proportion of the population uses orally inhaled substances such as tobacco, tobacco-related products, and other conventional smoked products. These substances, hereafter referred to collectively as "substance to be smoked", are usually burned, releasing smoke which is orally inhaled. Devices including pipes and paper-based cigarettes are used to facilitate smoking of a substance to be smoked in normal, ambient environmental conditions.

People who smoke often face a challenge during inclement weather conditions outdoors. Snow, rain, and other precipitation can damage both the substance to be smoked as well as the devices used to facilitate smoking (cigarette paper, filters, etc.). In addition, the requirement for fine digital motor movement to manipulate, prepare, and smoke a substance to be smoked often necessitates removal of protective clothing such as gloves. This can result in the exposure of bare skin to cold and moisture. For this reason, it would be desirable to provide a means to store, protect, and subsequently smoke a substance to be smoked, especially during inclement weather conditions and/or when the smoker is wearing protective clothing such as gloves.

SUMMARY OF THE INVENTION

The present invention provides a device that can be worn on the hand which will provide the normally expected skin protection of a glove while also providing the means to store, protect, and smoke or inhale a substance to be smoked. Smoking typically involves controlled burning of small amounts of the substance to be smoked followed by transport of the resulting smoke from the site of burning first to the mouth and subsequently into the lungs. The burning of the substance to be smoked at a site away from the mouth allows cooling of the temperature of the resulting smoke during transport, thus reducing or eliminating tissue damage from heat. Alternatively, vaporization involves heating a substance in a controlled manner without burning in order to release active components into vapor state for subsequent inhalation. For the purposes of this invention, subsequent references to smoking or smoke will also encompass the act of vaporization for inhalation of active ingredients of a substance to be smoked. Thus, there are three major features or components required of any effective smoking device:

1) a region in which to burn or heat the substance to be smoked in a controlled manner, hereafter referred to as the burning reservoir;
2) a region to facilitate physical transport and cooling of smoke from the site of burning to the mouth, hereafter referred to as the smoke transport pathway, and;
3) a region to interface with the mouth of the smoker and allow oral inhalation of the smoke into the lungs, hereafter referred to as the oral interface.

The present invention provides a hand worn smoking device comprising a glove having a burning reservoir for containing substance to be smoked, a reservoir closing feature, a smoke transport pathway, and an oral interface wherein the burning reservoir is connected to the oral interface via the smoke transport pathway allowing the burning reservoir to be in smoke communication with the oral interface during use. The present invention also provides a method of using this device for smoking the substance to be smoked.

DETAILED DESCRIPTION OF THE DRAWINGS

The features and inventive aspects of the present invention will become more apparent upon reading the following detailed description, claims, and drawings, of which the following is a brief description:

DESCRIPTION OF THE PREFERRED EMBODIMENT

I. Definitions

Figure 1:
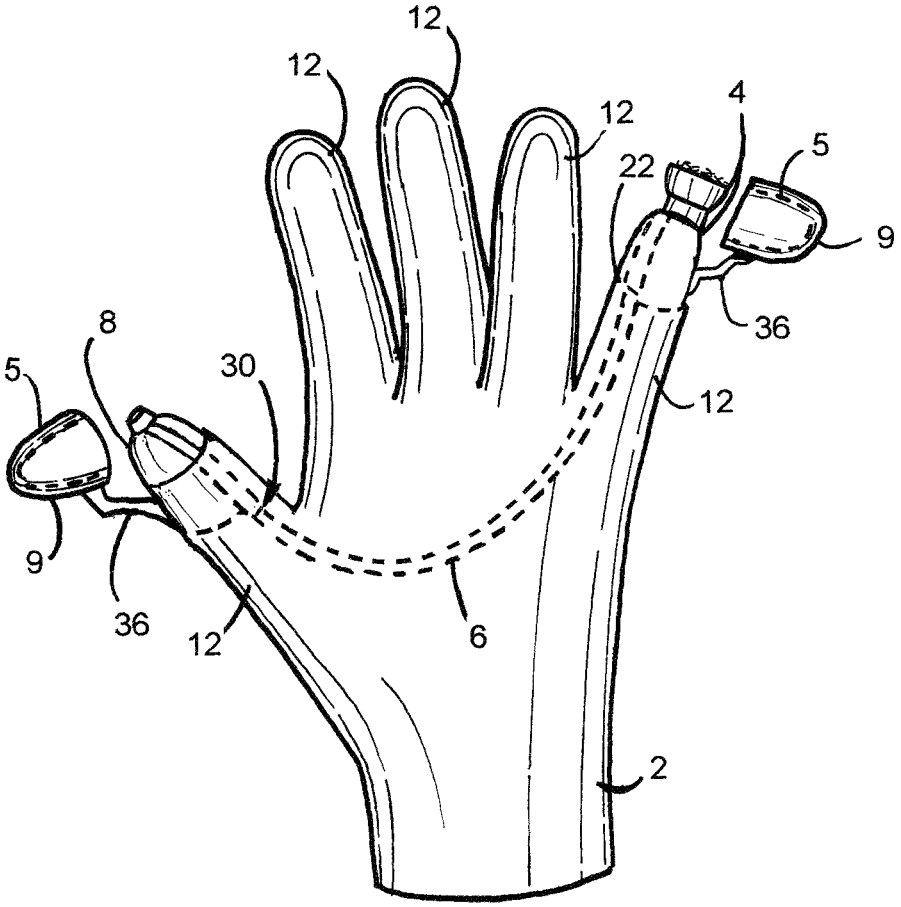
FIG. 1 illustrates a front (palm) view a hand wearing smoking device according to one embodiment of the present invention.

The following terms are intended to have the following general meanings as they are used herein:

Filter: a device or design feature that retains some component of the substance to be smoked upon burning of a substance to be smoked when the smoke is passed through it.

Heat sink: A passive component that is designed to cool a device by dissipating heat into the surrounding air.

Heating element: A material, such as metal or ceramic, that is heated using electrical energy to a temperature at which it can ignite a substance to be smoked that is in contact or close proximity to it.

Ignition/Ignite: The burning of a substance to be smoked to produce smoke for inhalation, accomplished via contact with flame, a heating element, or other suitable means.

Vaporization/Vaporize: The heating of a substance to be smoked to an elevated temperature, using thermal conduction, convection, or thermal radiation, without the presence of ignition, in order to force the active ingredients to enter the gas/vapor phase and allow subsequent inhalation.

Inclement weather conditions: any outdoor weather conditions that would allow for moisture exposure or cold temperature induced skin damage or discomfort. The type of weather condition commonly experienced when performing winter or snow related activities.

Lighter: a device containing a combustible fuel and means to ignite that fuel to produce a controlled flame for use in burning a substance to be smoked.

Smoker: an individual who intends to or actively partakes in burning and oral inhalation to the lungs of a substance to be smoked.

Substance to be smoked: any tobacco or tobacco related product, any other smoked products known in the art (e.g., cannabis for legal medical uses or the like) that is prepared and/or intended for smoking via oral inhalation to the lungs.

Tobacco or tobacco-related products: any natural or processed form of any part of the tobacco plant species. Any other substance, natural or synthetic, that is harvested or manufactured for the purpose of smoking via oral inhalation to the lungs.

Waterproof chamber: an enclosure or reservoir that, when in the closed formation, maintains an inner space or chamber and is impermeable to liquid water and water vapor.

Referring to FIGS. 1-5, an embodiment of the hand wearing smoking device 100 of the present invention is shown. The device 100 includes a glove 2 having a burning reservoir 4, a reservoir closing feature 5, a smoke transport pathway 6, and an oral interface 8 wherein the burning reservoir 4 is connected to the oral interface 8 via the smoke transport pathway 6 allowing the burning reservoir 4 to be in smoke communication with the oral interface 8 during use. The burning reservoir 4 is used to contain and burn the substance to be smoked 10 in a controlled manner. The smoke transport pathway 6 facilitates physical transport and cooling of smoke from the site of burning (e.g., the burning reservoir 4) to the oral interface 8. The oral interface 8 serves as the interface between the device 100 and the mouth of a smoker. It allows for oral inhalation of the smoke into the mouth (and then the lungs) of the smoker.

Figure 2:
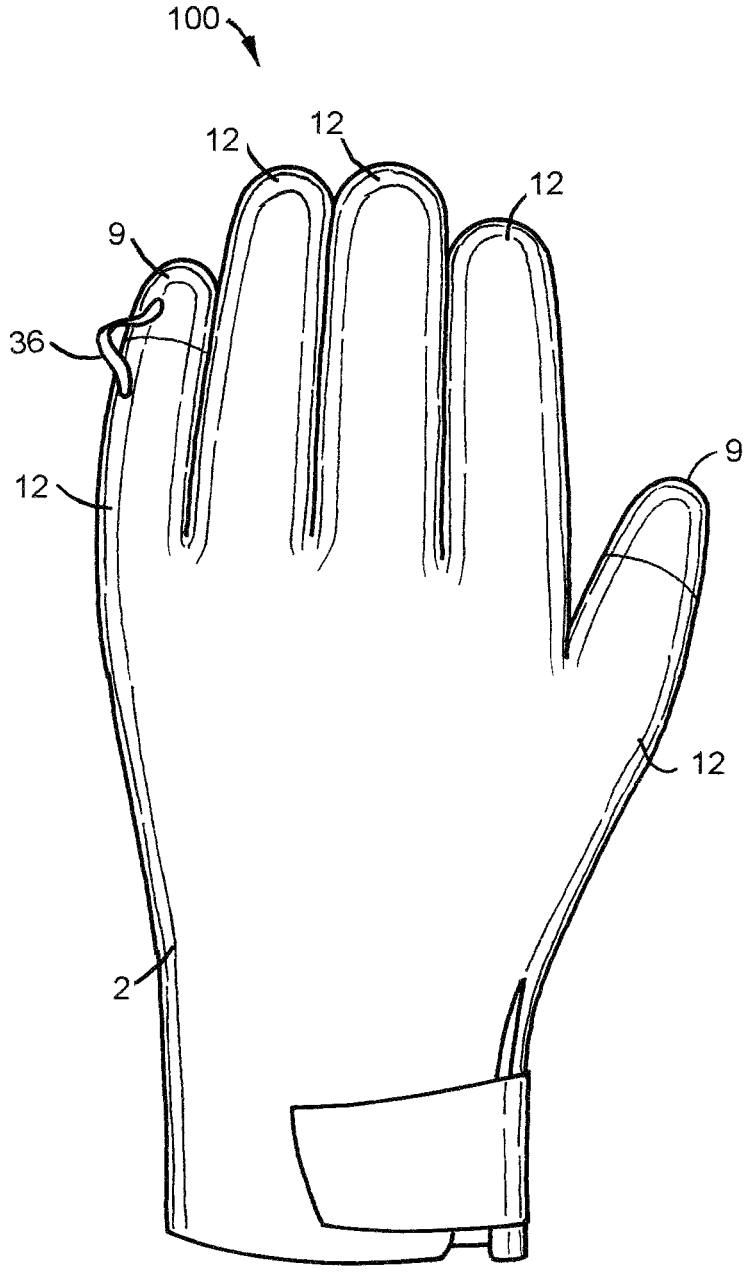
FIG. 2 illustrates a back view of the device shown in FIG. 1.

The glove 2 can be any glove. In one embodiment as shown in FIGS. 1-2, the glove 2 is a full fingered glove covering the entire hand of the smoker and provides a physical barrier to cold and moisture. Alternatively, the glove 2 may only cover some but not all fingers. The burning reservoir 4 is located at one of the finger features 12 of the glove 2. The burning reservoir 4 is shown in FIGS. 1-2 to be located on the distal portion of the little (also known as the "pinky") finger feature 12 of the glove 2. However, it is possible for the burning reservoir 4 to be located at another finger feature 12 of the glove 2 (such as the thumb, index, middle, ring finger feature). It is preferred that the burning reservoir 4 is located at a different finger feature 12 than the oral interface 8. It is also optional that the portion of the finger feature 12 surrounding the burning reservoir 4 (hereinafter known as the reservoir portion 14) contains heat resistance material. In one embodiment of the device 100 and referring to FIG. 3, the reservoir portion 14 includes the heat resistance material of silicon with a high heat rating of greater than 300 degree Fahrenheit. This exemplary silicon heat resistance material has a thickness of approximately between 0.2" to 0.185" forming the walls of the reservoir portion 14.

The oral interface 8 is located at one of the finger features 12 of the glove 2. The oral interface 8 is shown in FIGS. 1-2 to be located on the distal portion of the thumb finger feature 12 of the glove 2. However, it is possible for the oral interface 8 to be located at another finger feature of the glove 2 (such as the little/pinky, index, middle, or ring finger feature). It is preferred, but optional, that the burning reservoir 4, the smoke transport pathway 6, and the oral interface 8 are concealed within the glove 2 as shown in FIGS. 1-2 with a hiding feature 9. For example, the burning reservoir 4 and the oral interface 8 may also be fully or partially hidden from sight through the hiding feature such as a removable flap of fabric, zipper feature, solid plastic finger cap, or other similar means.

The smoke transport pathway 6 is connected to, and in smoke communication with, both the burning reservoir 4 and the oral interface 8 during use. In the embodiment of the present invention shown in FIGS. 1-2, the burning reservoir 4 is located at the distal portion of the pinky finger feature 12 of the glove 2 and the oral interface 8 is located at the distal portion of the thumb finger feature 12 of the glove 2 connected by the smoke transport pathway 8. The smoke transport pathway 6 includes an internal pathway, channel, or lumen for smoke to travel through in transit between the burning reservoir 4 and the oral interface 8. The smoke transport pathway 6 is constructed of suitable material that is impermeable to air. For example, the smoke transport pathway 6 can be constructed of a plastic, polymer, or flexible steel tubing with an inner lumen. In one embodiment of the present invention, the smoke transport pathway 6 comprises a flexible plastic or polymer tubing with inside diameter of 1/16" to ½". As noted above, the smoke transport pathway 6 may be fully or partially concealed within the device 100 using the hiding feature 9 such as a z as a removable flap of fabric, zipper feature, or other similar means. The smoke transport pathway 6 may be removable from the device 100 for the purposes of cleaning or replacement.

Figure 4:
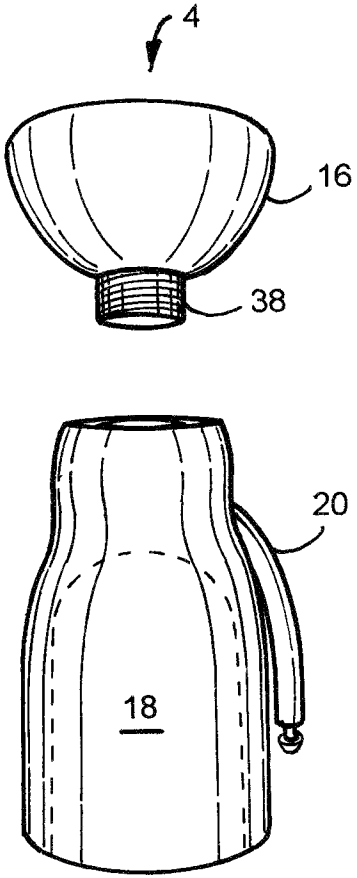
FIG. 4 illustrates a perspective exploded view of the burning reservoir shown in FIG. 3.
Figure 3:
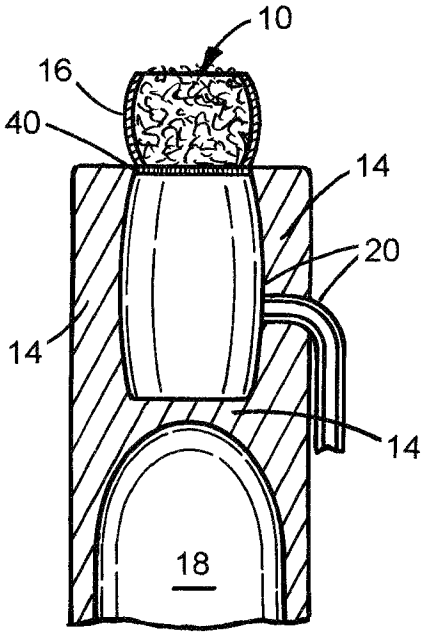
FIG. 3 illustrates a partial cross-sectional view of the device shown in FIG. 1 including a burning reservoir.

Referring to FIGS. 3-4, the burning reservoir 4 includes a chamber 16, a reservoir finger compartment 18, and a reservoir port feature 20. The chamber 16 is used to contain the substance to be smoked 10. The chamber 16 is connected to the reservoir port feature 20. The reservoir port feature 20 is connected to a first end 22 of the smoke transport pathway 6 in an airtight fashion using conventional connection means. For example, the reservoir port feature 20 is mated to the first end 22 of the smoke transport pathway using barb or push fitting components.

In one embodiment and as shown in FIG. 4, the chamber 16 is optionally constructed as a separate component that connects to the reservoir port feature 20 and the reservoir finger compartment 18 via conventional attachment means 38 such as threaded connection, luer lock connection, or the like. The chamber 16 can be removed from the remaining components of the burning reservoir 4 for the purpose of cleaning and/or manipulation. Referring to FIG. 3, the burning reservoir 4 may also optionally include a removable filter 40, constructed of suitable material such as paper, plastic or steel mesh, to be located inside the chamber 16 onto which the substance to be smoked 10 can be placed. The burning reservoir 4 is generally formed of rigid material(s). For example, the burning reservoir 4 may be constructed of plastic, polymer (e.g., thermostable polymer or the like), glass, metal (e.g., steel, aluminum, or the like), metal alloy and a combination of. It is optional that a portion of the reservoir finger compartment 18 is optionally constructed out of flexible or semi-rigid material that can fit over the tip of a finger comfortably while anchoring the burning reservoir 4 onto the smoker's finger in order to provide additional stability.

Figure 5:
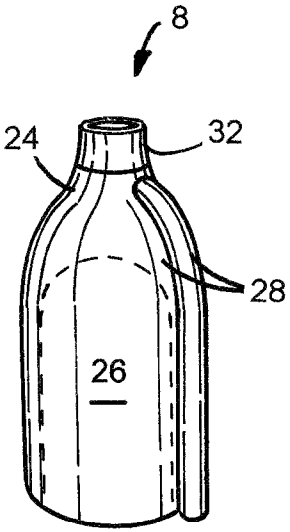
FIG. 5 illustrates a perspective view of an oral interface of the device shown in FIG. 1.

Referring to FIG. 5, the oral interface 8 includes an oral interface feature 24, an interface finger compartment 26, and an interface port feature 28. The oral interface 8 is generally formed of rigid material(s). For example, the oral interface 8 may be constructed of plastic, polymer (e.g., thermostable polymer or the like), glass, metal (e.g., steel, aluminum, or the like), metal alloy and a combination of. It is optional that a portion of the interface finger compartment 28 is optionally constructed out of flexible or semi-rigid material that can lit over the tip of a finger comfortably while anchoring the oral interface 8 onto the smoker's finger in order to provide additional stability. The oral interface feature 24 is connected to the interface port feature 28. The interface port feature 24 also connects to a second end 30 of the smoke transport pathway 6 in an airtight fashion as shown in FIG. 1 using conventional connection means. For example, the interface port feature 24 is mated to the second end 30 of the smoke transport pathway using barb or push fitting components. During use, the oral interface feature 24 is in smoke communication with the smoke transport pathway 6 via the interface port feature 28. The oral interface feature 24 is placed into a smoker's mouth allowing the smoker to receive smoke into his mouth where it can be inhaled into his lungs.

In another embodiment of the present invention, the oral interface feature 24 further includes a removable mouthpiece 32. The removable mouthpiece 32 serves as the interface between the device 100 and the smoker's oral cavity (e.g., mouth, teeth, lips, or the like). The removable mouthpiece 32 can be easily switched in and out for different smokers for hygiene purposes.

Figure 6:
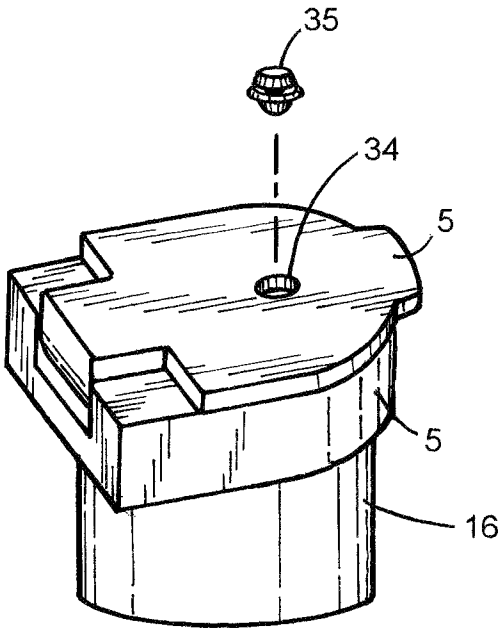
FIG. 6 illustrates a prospective view of a reservoir closing feature according to one embodiment of the present invention along with a portion of the burning reservoir shown in FIG. 4.

The burning reservoir 4 is designed to exist in both an open formation (as shown in FIG. 1) and a closed formation (as shown in FIG. 2) depending on manipulation of the reservoir closing feature 5. In one embodiment, the reservoir closing feature 5 is incorporated into the hiding feature 9 for the burning reservoir 4 in the form of a finger cap as shown in FIG. 1. In the open formation, the substance to be smoked 10 can be placed and rest inside the chamber 16 of the burning reservoir 4. In the closed conformation, the reservoir cap (hiding feature 9) is lowered along with the reservoir closing feature 5, creating a waterproof chamber containing the burning reservoir 4 that stores and protects the substance to be smoked 10 from moisture and outside environment. When the burning reservoir 4 is in the close formation, the reservoir closing feature 5 mates with the burning reservoir 4 to create a waterproof chamber within which the substance to be smoked 10 is contained and protected from the outside environment. The reservoir closing feature 5 can be any suitable means known in the art to form the waterproof chamber with the burning reservoir 4. For example, the reservoir closing feature 5 can be a lid incorporated into the reservoir cap 9 or a component completely separate from the reservoir cap 9 such as a hinged lid (shown in FIG. 6), a threaded lid, a tethered pressure fit lid, or the like. Furthermore, the reservoir closing feature 5 may also be comprised of a waterproof fabric or textile that can be optionally rolled or folded to create the waterproof chamber with the burning reservoir 4. Referring to FIG. 6, the reservoir closing feature 5 optionally includes a port 34 to enable air communication between the waterproof chamber containing the interior of the burning reservoir 4 and the outside environment when desired (e.g., during ignition of the substance to be smoked 10 and/or during smoking). A port closing feature 35 (e.g., a plug or the like) is provided to close the port 34 when desired to maintain the complete waterproof quality of the waterproof chamber.

The oral interface 8 is optionally designed to exist in both an open formation as shown in FIG. 1) and a closed formation (as shown in FIG. 2) depending on manipulation of the hiding feature 9 for the oral interface 8. In the embodiment shown in FIGS. 1-2, the hiding feature 9 is a linger cap. In the open formation, a smoker can be in smoke communication with the oral interface to obtain smoke from the burning reservoir 4 via the smoke transport pathway 6.

When a finger cap is used as the hiding feature 9, the finger cap 9 is attached to the glove 2 by a glove attachment feature 36. The glove attachment feature 36 allows the finger cap 9 to stay physically connected to the glove 2 when in open formation. The glove attachment features 36 can be attached to the exterior surface of the glove 2 as shown in FIGS. 1-2. Alternatively, it can optionally be located within the glove 2 and placed in an interior lining space that is between the exterior surface of the glove 2 and the interior lining of the glove 2.

During use of the device 100, the smoker would place a desired amount of the substance to be smoked 10 into the chamber 16 of the burning reservoir 4. It is advisable but not required that this action is taken prior to entering into inclement weather conditions. Once the substance to be smoked 10 is placed into the chamber 16, the reservoir closing feature 5 would then be closed, creating a waterproof chamber. The smoker could then wear the device 100 on the hand and perform activity, even in inclement weather conditions, for a period of time without damaging or destroying the substance to be smoked 10 through exposure to the outside environment (e.g., liquid water or water vapor from inclement weather conditions). When the smoker desires to smoke the substance to be smoked 10, he can access the chamber 16 by opening the reservoir closing feature 5. The substance to be smoked 10 can then be ignited and burned within the chamber 16 using an external source of flame. This will create smoke which can pass through the reservoir port feature 20 and into the smoke transport pathway 6. During ignition of the substance to be smoked 10, the smoker will close their mouth around the oral interface feature 24 of the oral interface 8 and create a negative air pressure inside the smoke transport pathway 5 and the oral interface 8 via inhalation. This negative pressure will draw the smoke through the smoke transport pathway 6 away from the chamber 16 of the burning reservoir 4 and towards the smokers mouth. The smoke will finally pass through the oral interface feature 24 and into the smoker's mouth to be subsequently inhaled into his lungs. Depending on the amount of substance to be smoked 10 that is placed inside the chamber 16 of the burning reservoir 4, the act of using the device 100 described above may be repeated multiple times in separate sessions. Accordingly, the present invention further a method of using the device 100 comprising of providing the device 100, placing substance to be smoked 10 into (the chamber 16 of) the burning reservoir 4; and igniting the substance to be smoked 10. The method may optionally include closing (the chamber 6 of) the burning reservoir 4 using the reservoir closing feature 5 having an open port 34. The method further includes inhaling smoke from the oral interface feature 8, which is in smoke communication with the burning reservoir 4 via the smoke transport pathway 6, wherein the smoke is provided by the substance to be smoked that has been ignited within the chamber 16 of the burning reservoir 4.

EXAMPLE I

Figure 7:
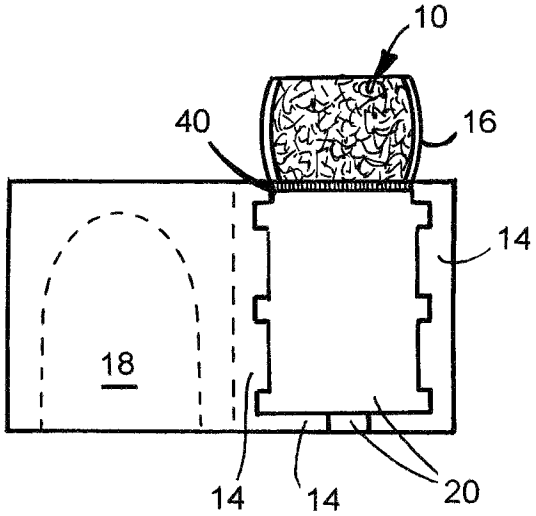
FIG. 7 illustrates a cross-sectional view of the burning reservoir according to one embodiment of the present invention.

An embodiment of the present invention is provided wherein the device is the same as the device 100 discussed above except that the chamber 16 is not located above (e.g., on top of) the reservoir finger compartment 18 but instead is located adjacent to the reservoir finger compartment 18 as shown in FIG. 7. Similarly, the oral interface 8 is not located above the interface finger compartment 26 but instead is located adjacent to the interface finger compartment 26.

EXAMPLE II

Figure 8:
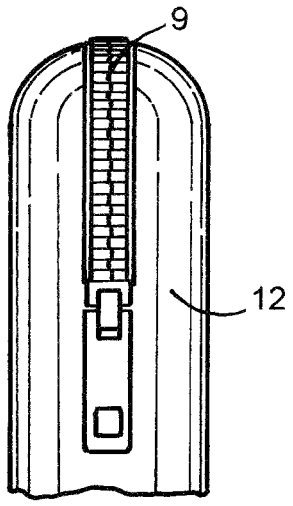
FIG. 8 illustrates a side view of a hiding feature accordingly to one embodiment of the present invention wherein the hiding feature is shown in a closed position.
Figure 9:
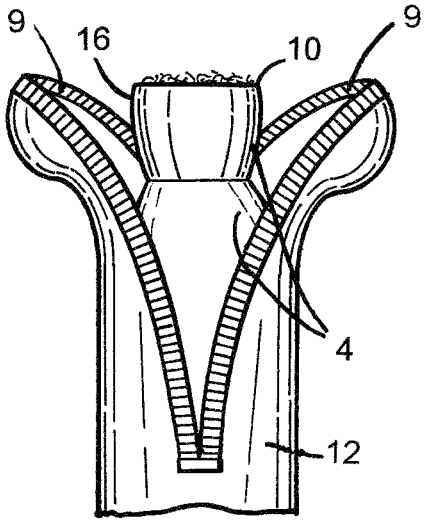
FIG. 9 illustrates another side view of the hiding feature shown in FIG. 8 wherein the hiding feature is shown in an opened position.
Figure 10:
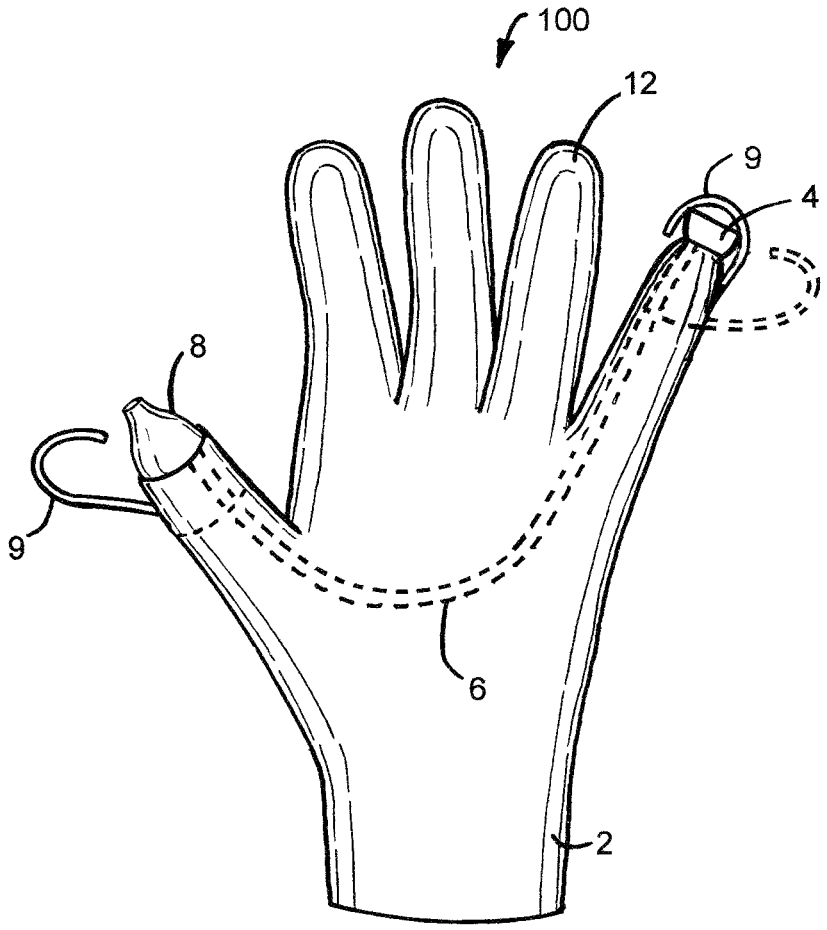
FIG. 10 illustrates a front (palm) view of a hand wearing smoking device according to another embodiment of the present invention.

Another embodiment of the present invention is provided wherein the device is the same as the device 100 discussed above with the hiding feature 9 for the burning reservoir 4 is a zipper as shown in FIGS. 8-9. In this embodiment, the optional hiding feature 9 for the oral interface 8 is also a zipper. The burning reservoir 4 and/or the oral interface 8 of the device 100 are fully hidden within the glove 2 when not in use and are accessible via the zipper (9). In yet another embodiment and referring to FIG. 10, the hiding feature 9 is a flap made of fabric or textile attached to the applicable finger feature 12 containing either the burning reservoir 4 or the oral interface 8. The flap (9) can be manipulated so as to cover its associated component such as the burning reservoir 4 or the oral interface 8. The flap (9) hides the burning reservoir 4 or the oral interface 8 from sight creating the appearance that the glove 2 is a normal glove. The flap (8) can also be pulled back to reveal either the burning reservoir 4 or the oral interface 8 during use of the device 100 in order to smoke the substance to be smoked 10. Furthermore, the hiding feature 9 may optionally include both the zipper (as shown in FIGS. 8-9) and the flap (as shown in FIG. 10) so that even when the flap is opened, its associated component (either the burning reservoir 4 or the oral interface 8) remains hidden until the zipper is unzipped and in the open position.

EXAMPLE III

Figure 11:
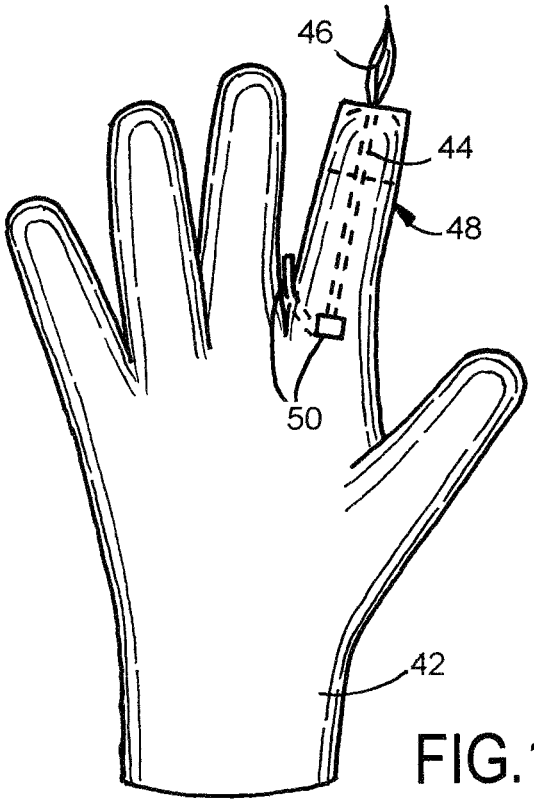
FIG. 11 illustrates a back view of a pairing glove according to one embodiment of the present invention.
Figure 12:
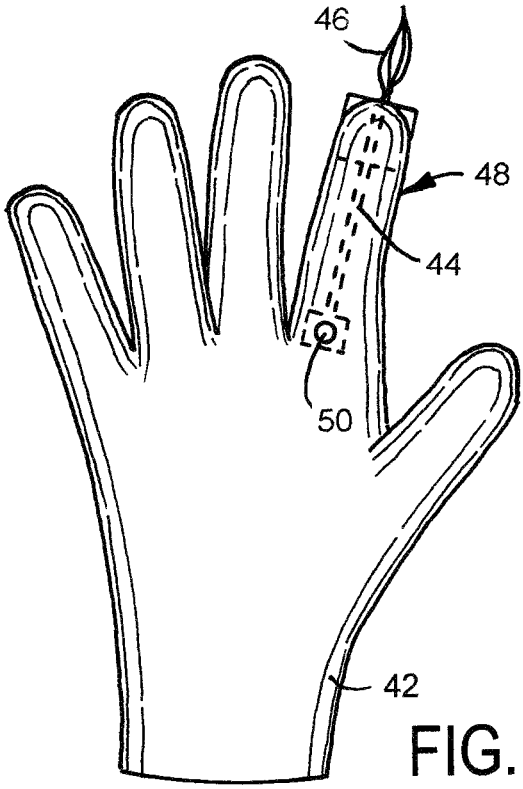
FIG. 12 illustrates a back view of a pairing glove according to another embodiment of the present invention.

Referring to FIGS. 11-12, an embodiment of the present invention is shown wherein a pairing Wove 42 which is the opposite of the glove 2 and forms a pair with the glove 2 is provided and includes a lighter 44. The lighter 44 could be operated without the need to remove the pairing glove 42. During use, the lighter 44 creates a flame 46 at the tip of a finger feature 48 (e.g., the index finger feature as shown in FIGS. 11-12) via ignition facilitated by a trigger mechanism 50 located at the base of the finger feature 48. The trigger mechanism 50 can be trigger by manipulation using another finger. Another embodiment of the trigger mechanism 50 is shown in FIG. 12 as a button located on the palm portion of the pairing glove 42. By pushing the button (i.e., the trigger mechanism 50), the lighter 44 is triggered and the desired flame 46 is provided.

EXAMPLE IV

Figure 13:
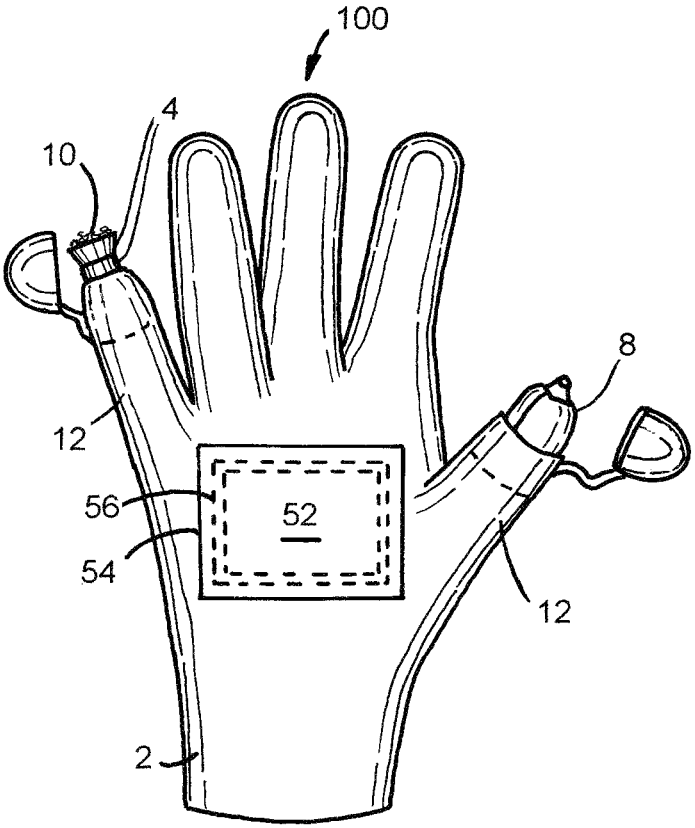
FIG. 13 illustrates a back view of the device shown in FIG. 1 further including a storage chamber.

Referring to FIG. 13, another embodiment of the present invention is shown wherein the device 100 further optionally includes a storage chamber 52 that is distinct and separate from the burning reservoir 4 in which to store the substance to be smoked 10 prior to smoking. It is optional that the storage chamber 52 should be waterproofed. It is preferred but not required that (i) the storage chamber 52 is located on the knuckle region of the non-palm side of the glove 2; and (ii) the storage chamber 52 is incorporated into the glove 2 and accessible by a Velcro flap 54 as shown in FIG. 13. Underneath the Velcro flap 54, the storage chamber 52 is a pouch-like chamber made of plastic or polymer with a flexible interlocking ridge and groove 56 to form a tight seal for accessing the inner portion of the storage chamber 52.

EXAMPLE V

Figure 14:
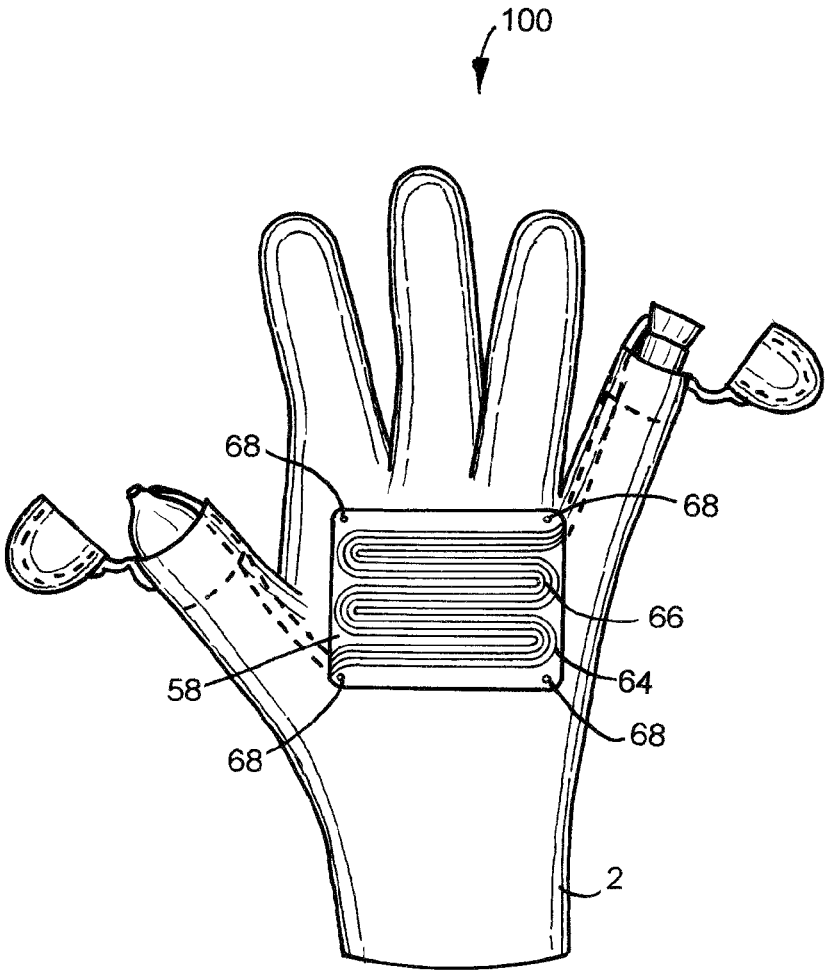
FIG. 14 illustrates a front (palm) view of the device shown in FIG. 1 further including a heat sink.
Figure 15:
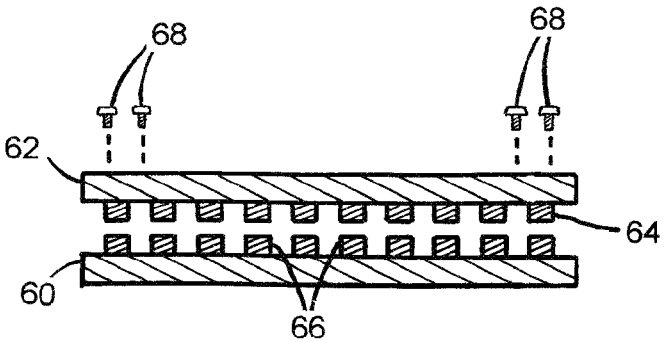
FIG. 15 illustrates a side exploded view of the heat sink shown in FIG. 14.

Referring to FIG. 14, an embodiment of the present invention is shown wherein the device 100 further optionally includes a heat sink 58 that is designed to cool smoke as it passes through the smoke transport pathway 6 prior to inhalation by the smoker via the oral interface 8. The smoke transport pathway 6 is placed in association with the heat sink 58 such that heat from the smoke passing through the smoke transport pathway 6 can be dissipated to the surrounding environment by the heat sink 58. The heat sink can be any suitable heat sink known in the art. For example and referring to FIG. 15, the heat sink 58 is comprised of a base layer 60 and a top layer 62. Both layers (60, 62) are constructed of a metal or metal alloy. The top layer 62 has fins 64 to increase the heat transfer rate. The base layer 60 contains a routed pathway 66 through which a portion of the smoke transport pathway 6 can run or flow through. The top layer 62 is fastened to the base layer 60 via fasteners 68 to seal the pathway 66.

EXAMPLE VI

Figure 16:
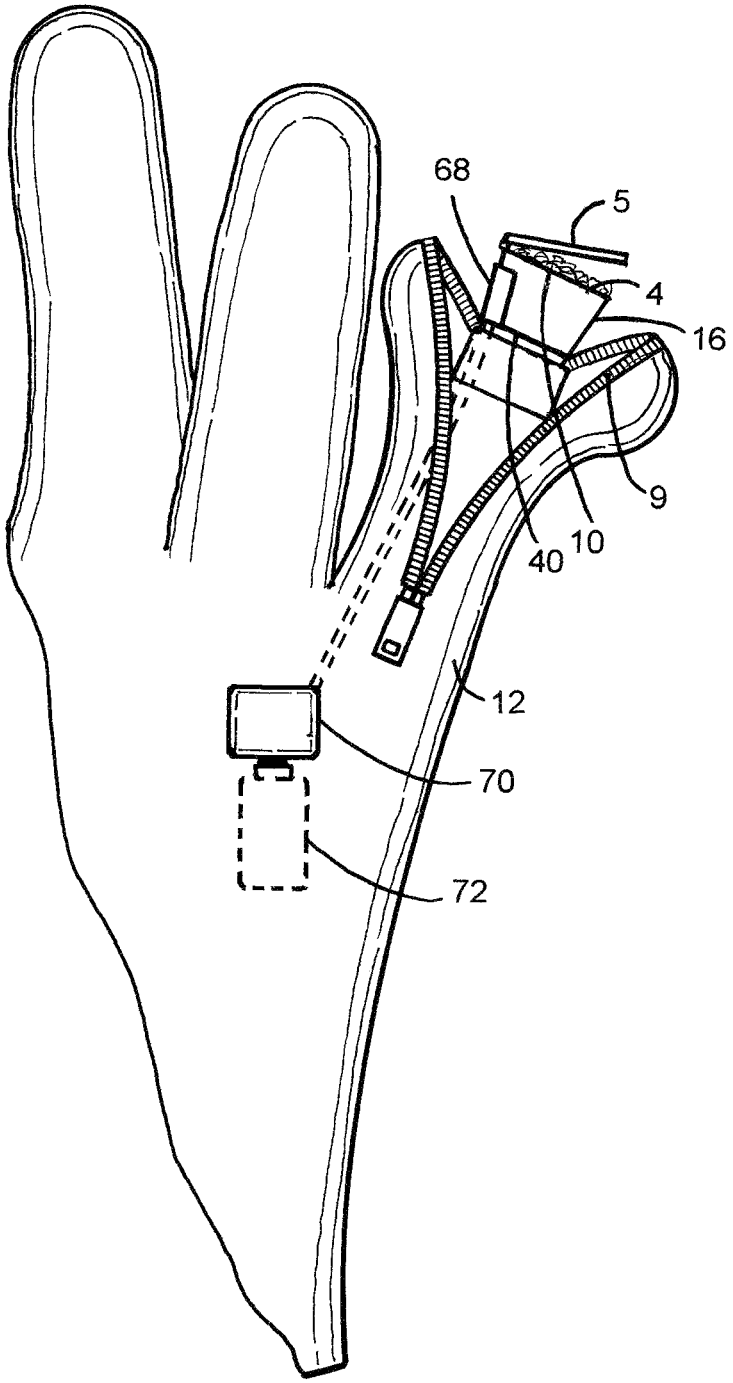
FIG. 16 illustrates a partial cross-sectional view of the device shown in FIG. 1 wherein the burning reservoir includes one embodiment of an optional lighting feature.
Figure 17:
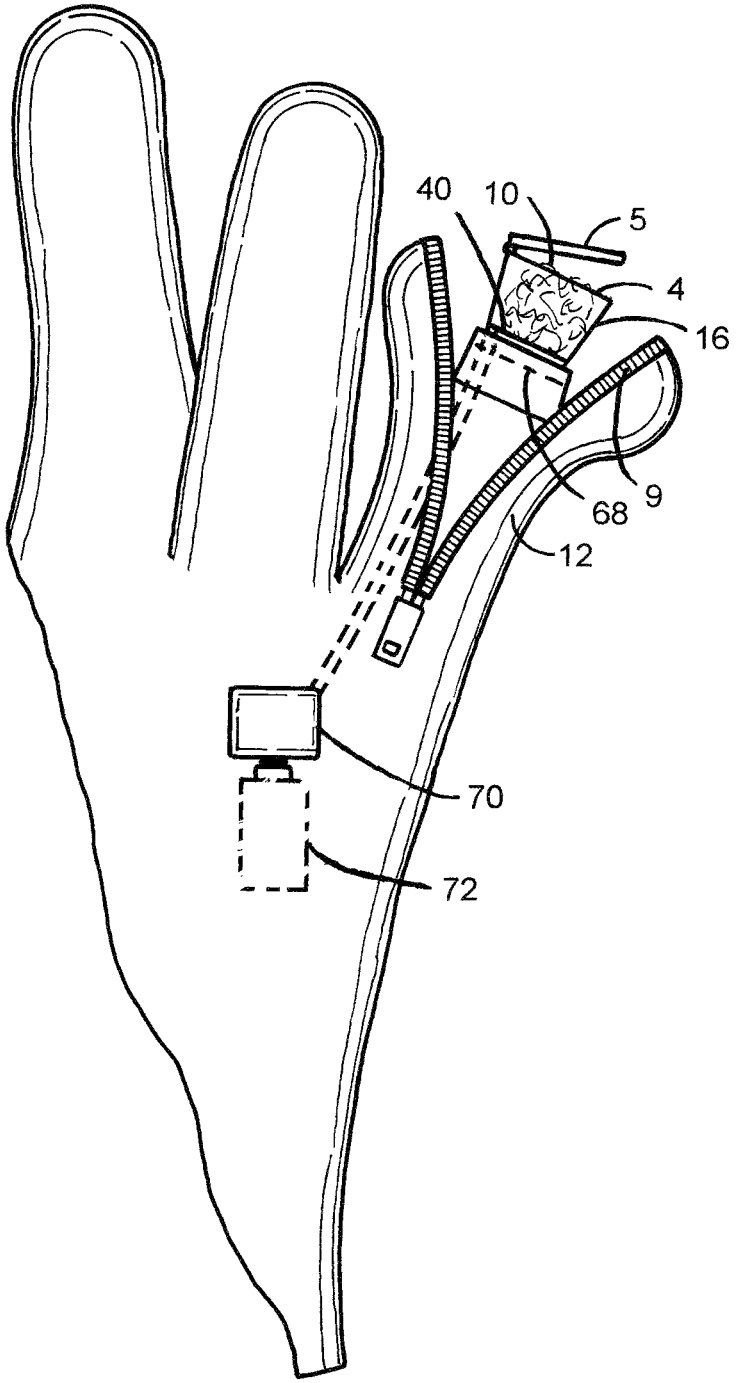
FIG. 17 illustrates a partial cross-sectional view of the device shown in FIG. 1 wherein the burning reservoir includes another embodiment of an optional lighting feature.

Referring to FIG. 16, another embodiment of the burning reservoir 4 is shown with an optionally included lighting feature 68 that is in communication with the chamber 16 and provides heat to ignite the substance to be smoked 10 contained within the chamber 16 of the burning reservoir 4. The light feature can be any suitable electrical component known in the art for its purpose such as a ceramic heating element or the like. The light feature includes an on/off switch or button 70 connected to a battery 72 within the glove 2 that determines when ignition is to be provided. Alternatively and referring to FIG. 17, the lighting feature 68 is a vaporization means that can heat the substance to be smoked 10 contained within the chamber 16. The vaporization means can be any suitable component known in the art for its purpose, and can achieve heating of the substance to be smoked via thermal conduction, convection, or thermal radiation. The vaporization means (68) within the chamber 16 is in electrical communication with an on/off switch or button 70 of the lighting feature 68 connected to a battery 72 within the glove 2 that determines when vaporization is to be activated.

EXAMPLE VII

Figure 18:
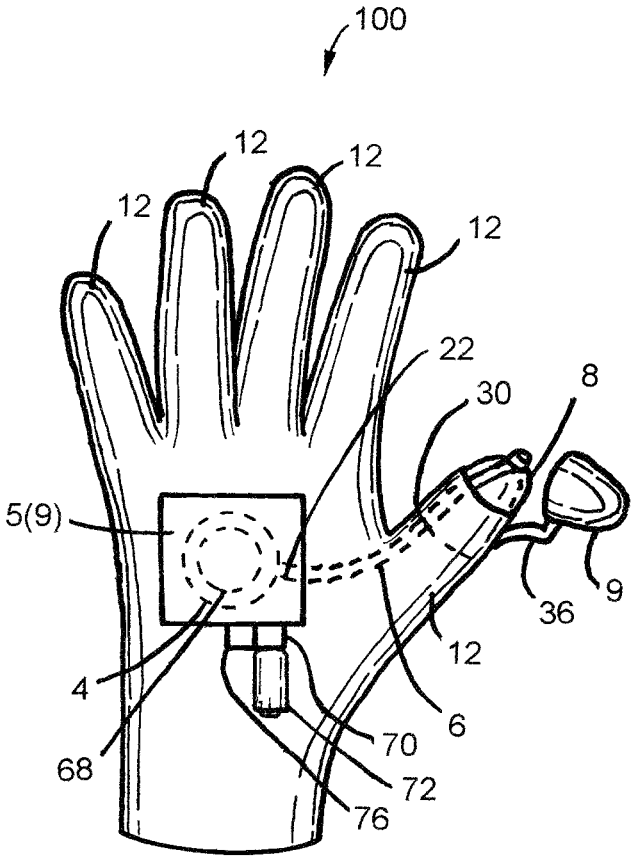
FIG. 18 illustrates a back view of another embodiment of the present invention.

Another embodiment of the device 100 is provided wherein either one or both of the burning reservoir 4 or oral interface 8 could be located in or on the hand 74 (as shown in FIG. 18) or wrist section of the glove 2 (i.e., not within the finger feature 12). In this embodiment, the burning reservoir 4 and oral interface 8 would still be in communication via the smoke transport pathway 6 and integrated into the glove 2 construction. For example, the burning reservoir 4 comprising a chamber (e.g., similar to 16 of FIG. 4) is integrated into the back of the hand section of the glove 2 and the oral interface 8, with its hiding feature 9 (shown here as a finger cap) with the glove attachment feature 36, is located at the thumb finger feature 12 of the glove 2. The burning reservoir 4 further includes a switch 76 (button, toggle, sliding switch, or the like) located within the glove 2 that can open the burning reservoir closing feature 5. The burning reservoir 4 may optionally further include the lighting feature 68 discussed in Example VI wherein the lighting feature 68 is vaporization means within the chamber of the burning reservoir 4 is in electrical communication with an one/off switch or button 70 of the lighting feature 68 connected to a battery 72 within the glove 2 that determines when vaporization is to be activated during operation to heat the substance to be smoked 10 (not shown in FIG. 18) contained within the chamber of the burning reservoir 4.

What is claimed is:

1. A hand worn smoking device comprising a glove having a burning reservoir for containing substance to be smoked, a reservoir closing feature, a smoke transport pathway, an oral interface wherein the burning reservoir is connected to the oral interface via the smoke transport pathway allowing the burning reservoir to be in smoke communication with the oral interface during use when smoke travels from the burning reservoir to the oral interface in order to allow for oral inhalation of the smoke by a user and wherein (i) the oral interface is located at a finger feature of the glove; (ii) the burning reservoir includes a chamber and a reservoir port feature connected to a first end of the smoke transport pathway; (iii) the oral interface includes an oral interface feature and a interface port feature connected to a second end of the smoke transport pathway; (iv) the reservoir closing feature mates with the burning reservoir when the burning reservoir is in a closed formation and (v) the reservoir closing feature further includes:

(a) a port to enable air communications between the chamber and the outside environment even When the burning reservoir is in the closed formation; and (b) a port closing feature to close the port when desired.

2. The device of claim 1 wherein (i) the burning reservoir further includes a reservoir finger compartment; and (ii) the oral interface further includes an interface finger compartment.

3. The device of claim 2 wherein the chamber is located above the reservoir finger component.

4. The device of claim 1 wherein the chamber is a separate component that can be removed from its connection with remaining components of the burning reservoir.

5. The device of claim 1 wherein the oral interface further includes an interface finger compartment.

6. The device of claim 1 wherein the oral interface further includes a removable mouthpiece.

7. The device of claim 1 wherein the oral interface includes a mouthpiece that can be manipulated back and forth between an open and closed position/conformation.

8. The device of claim 1 wherein the reservoir closing feature is a lid having the port to enable air communication between the chamber and the outside environment even when the burning reservoir is in the closed formation.

9. The device of claim 1 further comprising hiding features for at least one component selected from the group consisting of the burning reservoir, the oral interface, and the smoke transport pathway.

10. The device of claim 9 wherein the hiding features for the burning reservoir and the oral interface are finger caps.

11. The device of claim 9 wherein the hiding features for the burning reservoir and the oral interface are selected from a group consisting of zippers, flaps, and a combination thereof.

12. The device of claim 1 wherein the glove is an insulated glove designed for warmth during inclement weather conditions.

13. The device of claim 1 wherein the burning reservoir is constructed of as material selected from a group consisting of plastic, polymer, glass, metal, metal alloy and a combination of.

14. The device of claim 1 wherein the finger feature where the oral interface is located is a thumb finger feature and wherein the burning reservoir is located at a little finger of the glove.

15. The device of claim 1 wherein the burning reservoir includes a removable filter on which the substance to be smoked can be placed.

16. The device of claim 1 wherein the smoke transport pathway is a tubing constructed of material selection from the group consisting of plastic, polymer, flexible metal tubing and a combination thereof.

17. The device of claim 1 further comprising a pairing glove having a lighter for ignition of the substance to be smoked.

18. The device of claim 1 wherein the glove further includes a storage chamber to store the substance to be smoked prior to the use.

19. The device of claim 1 wherein the burning reservoir further includes a lighting feature for ignition of the substance to be smoked.

20. The device of claim 1 further comprising a heat sink to cool smoke contained within a portion of the smoke transport pathway.

21. A method of using a hand worn smoking device comprising:

(a) providing the device comprising a glove having a burning reservoir for containing substance to be smoked, a reservoir closing feature, a smoke transport pathway, an oral interface wherein the burning reservoir is connected to the oral interface via the smoke transport pathway allowing the burning reservoir to be in smoke communication with the oral interface during use when smoke travels from the burning reservoir to the oral interface in order to allow for oral inhalation of the smoke by a user and wherein (i) the oral interface is located at a finger feature of the glove; (ii) the burning reservoir includes a chamber and a reservoir port feature connected to a first end of the smoke transport pathway; (iii) the oral interface includes an oral interface feature and a interface port feature connected to a second end of the smoke transport pathway; (iv) the reservoir closing feature mates with the burning reservoir when the burning reservoir is in a closed formation and (v) the reservoir closing feature further includes a port to enable air communications between the chamber and the outside environment even when the burning reservoir is in the closed formation; and a port closing feature to close the port when desired;

(b) placing substance to be smoked into the burning reservoir;

(c) igniting the substance to be smoked; and (d) inhaling smoke from the oral interface feature, which is in smoke communication with the burning reservoir via the smoke transport pathway, wherein the smoke is provided by the substance to be smoked that has been ignited within the burning reservoir.

* * * * *